US008511766B2

(12) United States Patent
Sonnenfroh et al.

(10) Patent No.: US 8,511,766 B2
(45) Date of Patent: Aug. 20, 2013

(54) MODULAR REFRIGERATION DEVICE

(75) Inventors: Irena Sonnenfroh, Giengen (DE); Jörg Stelzer, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1402 days.

(21) Appl. No.: 11/918,500

(22) PCT Filed: Mar. 28, 2006

(86) PCT No.: PCT/EP2006/061102

§ 371 (c)(1),
(2), (4) Date: Oct. 10, 2007

(87) PCT Pub. No.: WO2006/120064

PCT Pub. Date: Nov. 16, 2006

(65) Prior Publication Data

US 2009/0038335 A1 Feb. 12, 2009

(30) Foreign Application Priority Data

May 10, 2005 (DE) ..... 10 2005 021 555

(51) Int. Cl.
*A47B 96/04* (2006.01)

(52) U.S. Cl.
USPC ..... 312/401; 312/296

(58) Field of Classification Search
USPC ..... 312/107, 108, 111, 296, 401; 277/645, 277/650, 652–654, 921
See application file for complete search history.

(56) References Cited

U.S. PATENT DOCUMENTS

| | | | | |
|---|---|---|---|---|
| 5,011,163 | A * | 4/1991 | Hermann et al. | 277/653 |
| 5,674,567 | A * | 10/1997 | Kausch et al. | 427/385.5 |
| 5,800,912 | A * | 9/1998 | Ogiso et al. | 428/323 |
| 6,849,310 | B2 * | 2/2005 | Willett | 428/31 |
| 2006/0005472 | A1 * | 1/2006 | Miller | 49/498.1 |

FOREIGN PATENT DOCUMENTS

| | | |
|---|---|---|
| GB | 1559251 | 1/1980 |
| JP | 5-164458 | 6/1993 |
| JP | 10-292981 | 11/1998 |
| WO | WO 84/03659 | 9/1984 |
| WO | WO 2004/001305 | 12/2003 |
| WO | WO 2006/013182 | 2/2006 |

OTHER PUBLICATIONS

English translation of King et al. WO 2004/001305 from EPO website.*
International Search Report PCT/EP2006/061102.

* cited by examiner

*Primary Examiner* — Darnell Jayne
*Assistant Examiner* — Daniel Rohrhoff
(74) *Attorney, Agent, or Firm* — James E. Howard; Andre Pallapies

(57) ABSTRACT

A refrigeration device is provided with a housing having an interior and at least one housing part. The housing and the at least one housing part are interlinked to form a single unit. A sealing profile is arranged in the form of a frame-type structure between surfaces of the walls of the housing facing each other. The sealing profile consists of a compressible foam strand that is provided with a diffusion-inhibiting membrane extending between the surfaces.

31 Claims, 3 Drawing Sheets

MODULAR REFRIGERATION DEVICE

The present invention relates to a refrigeration device having a modular design wherein a housing having an interior and at least one housing part are interlinked to form a single unit. Known refrigeration devices of this type are what are referred to as side-by-side devices in which a refrigerator part and a freezer part each have autonomous housings which are arranged side by side. Between the said housings' side walls that face each other there exists a narrow air gap which, because it is hardly warmed by inflow of heat from the environment, can easily reach temperatures during operation of the device in which moisture from the air penetrating into the gap condenses.

In order to prevent condensation from moisture in the gap, it was initially proposed to heat the gap. However, this solution is extremely unsatisfactory because it makes the power consumption of the combined refrigeration device higher than that of two independent devices set up at a distance from each other. In order to remedy this disadvantage it was proposed in DE 20209516 U1 to close off the gap between two housing parts in an airtight manner by means of a seal. Any plastic or rubber or other material with a suitable sealing effect is recommended as the seal; silicon is cited as an example.

However, practical experience shows that it is difficult to keep moisture away from the gap permanently by means of a sealing profile of said kind. Due on the one hand to the technology with which the refrigeration device housings are manufactured and the often slightly curved exterior surfaces on the housing parts, and on the other hand to the difficulty of setting up the two housing parts in such a way that their facing wall surfaces are exactly parallel and also remain so during the entire lifecycle of the device, it is very difficult with the conventional seals to guarantee satisfactory tightness of the seal over the entire perimeter of the walls facing each other.

The object of the present invention is to specify a refrigeration device comprising a housing having an interior and at least one housing part that is joined to said housing to form a single unit wherein a gap between facing surfaces of the housing and the housing part is permanently protected from penetration by moisture.

The invention achieves said object with the aid of a frame-shaped sealing profile made of a strand of compressible foamed plastic material provided with a diffusion-inhibiting membrane and disposed between the facing surfaces of the housing and the housing part. In contrast to the known solid seal the foamed plastic strip does not in fact have to be able to prevent the passage of moisture, but instead it is possible without difficulty to compress it to a small fraction of the thickness that it has in the relaxed state, and thus to fill the gap with it everywhere over its entire width, even if the gap between the surfaces facing each other is wider by a multiple at its widest point than at its narrowest. The task of preventing the passage of moisture, which the foamed plastic is not able to fulfill satisfactorily, in particular if it is an open-cell type of foam, is handled by the diffusion-inhibiting membrane which extends between the surfaces.

In order to ensure a tight contact between the membrane and the surfaces of the housing and the housing part, the membrane is preferably arranged in a close-fitting manner on the latter over a part of its width in each case.

This is particularly easy to ensure if the membrane is applied to the surface of the strand of foamed plastic.

A simple and inexpensive way to obtain the sealing profile is to take a foamed plastic strip which is coated with adhesive on one side and carries the membrane on the other side and fold it lengthwise so that the adhesive comes to be on the inside of the sealing profile and holds the folded strip in shape. A strip of this kind can be obtained in a particularly easy manner in that the membrane is applied over the full surface area on a foamed plastic sheet or in that a base material of the foamed plastic is applied onto the membrane and allowed to expand thereon, and in that the composite obtained in this way is cut into strips of the required width.

According to another embodiment the membrane forms a tube enclosing the foamed plastic strand. With this embodiment it is not absolutely necessary for the membrane and the foamed plastic strand to be joined to one another in the form of a material connection.

The tube is preferably formed by joining the longitudinal edges of at least one membrane strip. The join of the longitudinal edges to one another is advantageously produced with the inclusion of the foamed plastic strand.

In order to achieve a high diffusion barrier effect, a membrane can be used which includes a layer made of metal, in particular aluminum. Preferably the membrane is a plastic-metal laminated film.

A preferred plastic for the membrane is polychlorotrifluoroethylene (PCTFE) owing to its high barrier effect against moisture.

The sealing profile is preferably stuck to at least one of the surfaces of the housing or of the housing part, preferably by means of a double-sided adhesive tape. In this way it is possible to secure the sealing profile to one surface before the housing and the housing part are joined to each other.

It is also beneficial to stick the sealing profile to the facing surfaces of the housing and of the housing part. By this means the tightness of the seal can also be maintained if the width of the gap becomes slightly larger than that of the sealing profile in the relaxed state, for example because the base surface on which the device is set up moves.

The housing part can be a second housing having an interior or also simply an insulating panel supplementing the insulation of the first housing.

Further features and advantages of the invention will emerge from the following description of exemplary embodiments with reference to the attached figures, in which.

Figure 1:
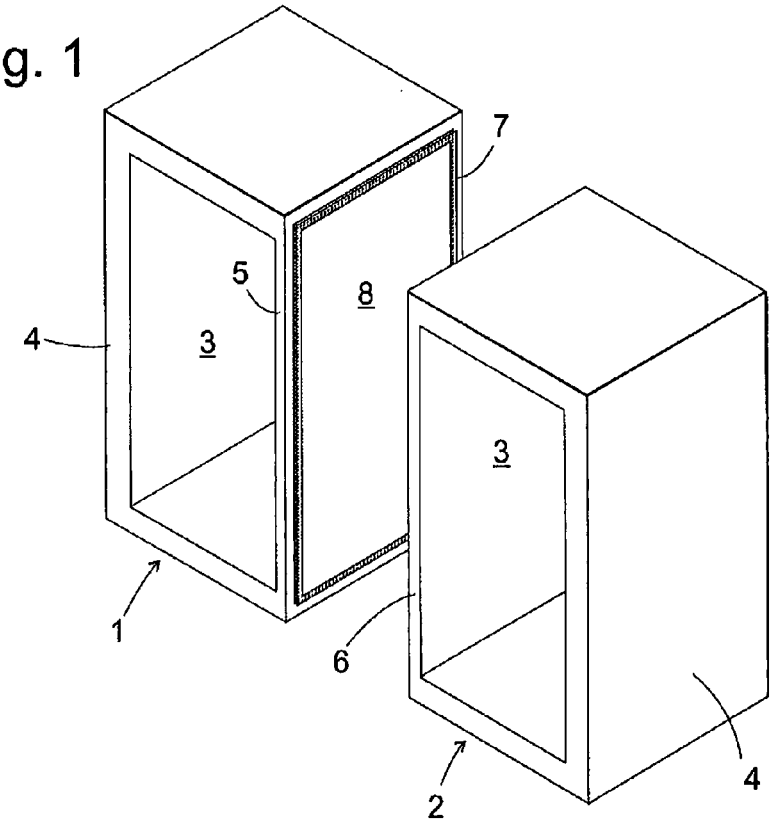
FIG. 1 shows a perspective exploded view of two housing parts of a refrigeration device having disposed between them a frame-shaped sealing profile according to the present invention.

FIG. 1 shows a perspective exploded view of a refrigeration device comprising two housings 1, 2, each of which has a refrigerated interior 3. For simplicity, the doors hinged to the side walls 4 which face away from each other of the housings 1, 2 are not shown. Of the two side walls 5, 6 which face each other of the housings 1, 2, one, in this case the side wall 5, is provided with a sealing profile 7 forming a rectangular frame. The elastically compressible sealing profile 7 is provided in order to close off a free space 8 surrounded by it between the two side walls 5, 6 in an airtight and moisture-proof manner when the two housings 1, 2 are placed against each other.

Since the temperature gradient between the two interiors 3 across the side walls 5, 6 is significantly less than from the interiors 3 via one of the side walls 4 to the outside, the side walls 5, 6 can be designed considerably thinner than the side walls 4.

Figure 2:
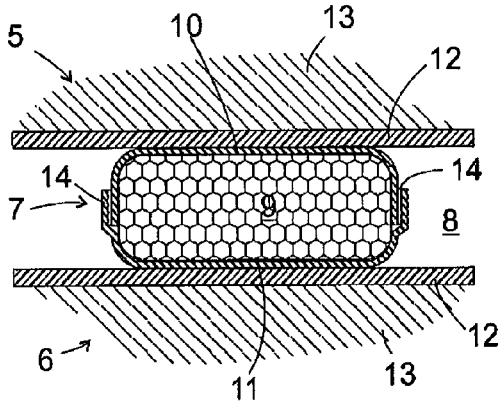
FIG. 2 shows a section through the sealing profile and housing walls adjacent to it according to the first embodiment of the invention.

FIG. 2 shows a section through the sealing profile 7 and adjacent areas of the side walls 5, 6 according to a first embodiment of the invention. The sealing profile 7 is formed by means of a foamed plastic strand 9 which is disposed between two strips 10, 11 of a diffusion-inhibiting film. The film strips 10, 11 are wider than the foamed plastic strand 9, and edge zones of the film strips projecting laterally above the foamed plastic strand 9 are in each case folded over and stuck to one another in a tight-fitting manner on the lateral faces of the foamed plastic strand 9 in order thereby to tightly enclose the foamed plastic strand 9. The film can be, for example, a film made of polychlorotrifluoroethylene with a strength of 100 μm which has excellent moisture-proofing properties or a plastic-metal laminated film, in particular having an aluminum layer.

The foamed plastic strand 9 is compressed between the side walls 5, 6 facing each other so that the film strips 10, 11 in each case fit tightly against the outer skin 12 of the side wall 5 and 6 across the entire width of the sealing profile 7.

Shown behind the fixed outer skin 12 made of metal or plastic in each case is a piece of an insulating foam filling 13 of the side wall 5 and 6.

The moisture-proofing effect of an adhesive layer 14 which in each case holds together the edge zones of the film strips 10, 11 can be less than that of the film itself. Since the adhesive layer 14 must be penetrated in the width direction, the amount of moisture infiltrating via it into the free space 8 is nonetheless negligible.

Figure 3:
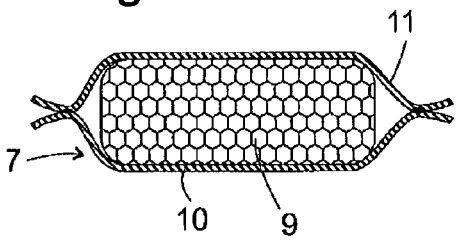
FIG. 3 shows a cross-section through a sealing profile according to a second embodiment of the invention.

FIG. 3 shows a second embodiment of the sealing profile 7 in section. The foamed plastic strand 9 and the film strips 10, 11 are the same as in the embodiment of FIG. 2, with the difference that in FIG. 3 the edges of the strips 10, 11 projecting beyond the foamed plastic strand 9 are not stuck in an overlapping manner, but simply pressed against each other from two sides in a pinching manner and welded. Since the width of the weld seam 15 can be made considerably greater than the strength of the film, a sufficient diffusion tightness of the weld seam 15 can be ensured without difficulty.

Instead of welding the film edges, a join by means of an adhesive layer could, of course, also be provided with this embodiment.

Figure 4:
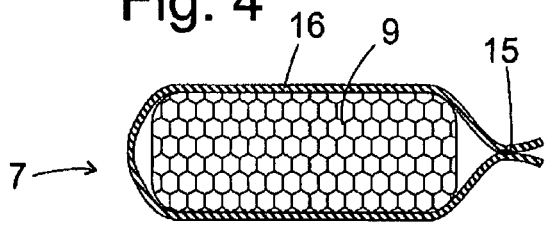
FIG. 4 shows a section through the sealing profile according to a third embodiment.

In the embodiment of FIG. 4, a single film strip 16 is provided which is folded around the foamed plastic strand 9 and its edges are joined together on a narrow side of the foamed plastic strand 9 by means of a weld seam 15. Said narrow side preferably forms the side of the sealing profile 7 facing the free space 8 in each case.

Figure 5:
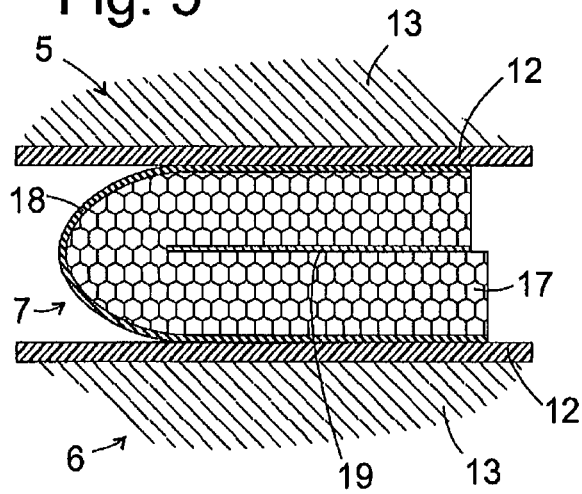
FIG. 5 shows a section through the sealing profile and adjacent housing walls according to a fourth embodiment.

An embodiment of the sealing profile that is particular easy to implement is shown in FIG. 5. In this case a foamed plastic strand 17 is used which originally is twice as wide but only half as thick as the strand 9 of the previously considered embodiments and which is provided on one side, over the entire surface area and in a material connection, with a film 18 acting as a diffusion barrier. The material and structure of the film can be the same as in the case of the strips 10, 11, 16 of the preceding embodiments.

A surface of the foamed plastic strand 17 opposite the film 18 is provided with an adhesive layer 19 and then the strand 17 is folded lengthwise, the adhesive layer 19 coming to lie internally and the film 18 externally. In this way the sealing profile 7 shown in FIG. 5 is obtained.

The adhesive layer 19 can be a liquid adhesive that is spread or sprayed on; preferably it is formed by a double-sided adhesive tape which is applied over half the width of the foamed plastic strand 17.

Figure 6:
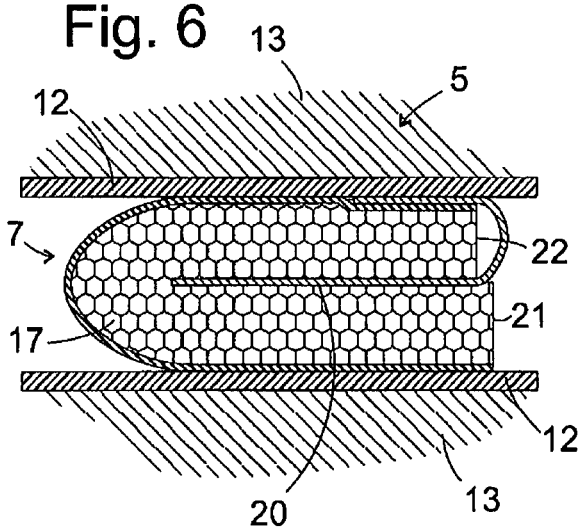
FIG. 6 shows a section analogous to FIG. 5 according to a development of the fourth embodiment.

According to an advantageous development shown in FIG. 6, the double-sided adhesive tape designated by 20 in this figure is applied to the foamed plastic strand 17 before the longitudinal fold so as to project over one of its longitudinal edges 21, 22, and after the longitudinal fold of the foamed plastic strand 17 the projecting area of the adhesive tape 20 is folded around the longitudinal edge 21 such that a part of it comes to lie externally on the film 18, covering the latter on a part of its width facing the side wall 5. With the aid of said outside section of the adhesive tape 20 the sealing profile 7 can be mounted directly on the side wall 5.

Figure 7:
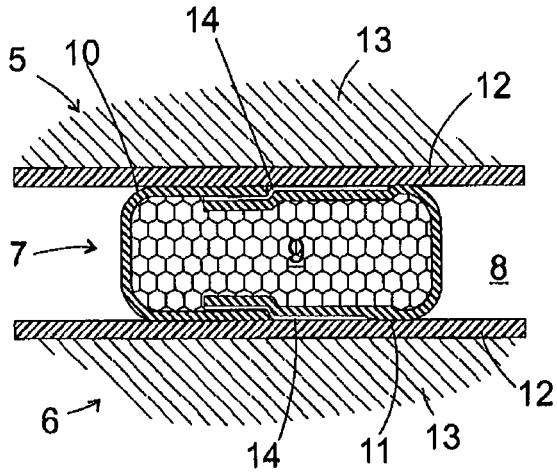
FIG. 7 shows a fifth embodiment of the sealing profile and adjacent housing walls in section.

A further embodiment of the sealing profile 7 is shown in FIG. 7. As in the case of the embodiments of FIGS. 2 and 3, in this case too a foamed plastic strand 9 is enveloped in two strips 10, 11 of a diffusion-inhibiting film. That said, however, in this case the two strips 10, 11 each overlap between the strand 9 and the adjacent side walls 5 and 6 respectively, and the strip 10 faces outward, whereas the other strip 11 faces the free space 8.

The film strips 10, 11 are joined at their two edges by means of strips 14 of double-sided adhesive tape which extend beyond the edges of the strip 10 onto the outer surface of the strip 11, between these and the side walls 5 and 6 and adhere to these. The adhesive tape strips 14 will maintain a tight contact between the film and the walls 5, 6 even if over the course of time the gap between the walls 5, 6 were to become slightly wider than the thickness of the sealing profile in the uncompressed state.

The profiles 7 of FIGS. 2 to 6 could, of course, also be provided with an adhesive layer on both surfaces touching the walls 5 and 6, whether in the form of a double-sided adhesive tape or, for example, as an applied liquid adhesive, in order to enable an adhesion to the walls 5, 6 in the uncompressed state as well.

Figure 8:
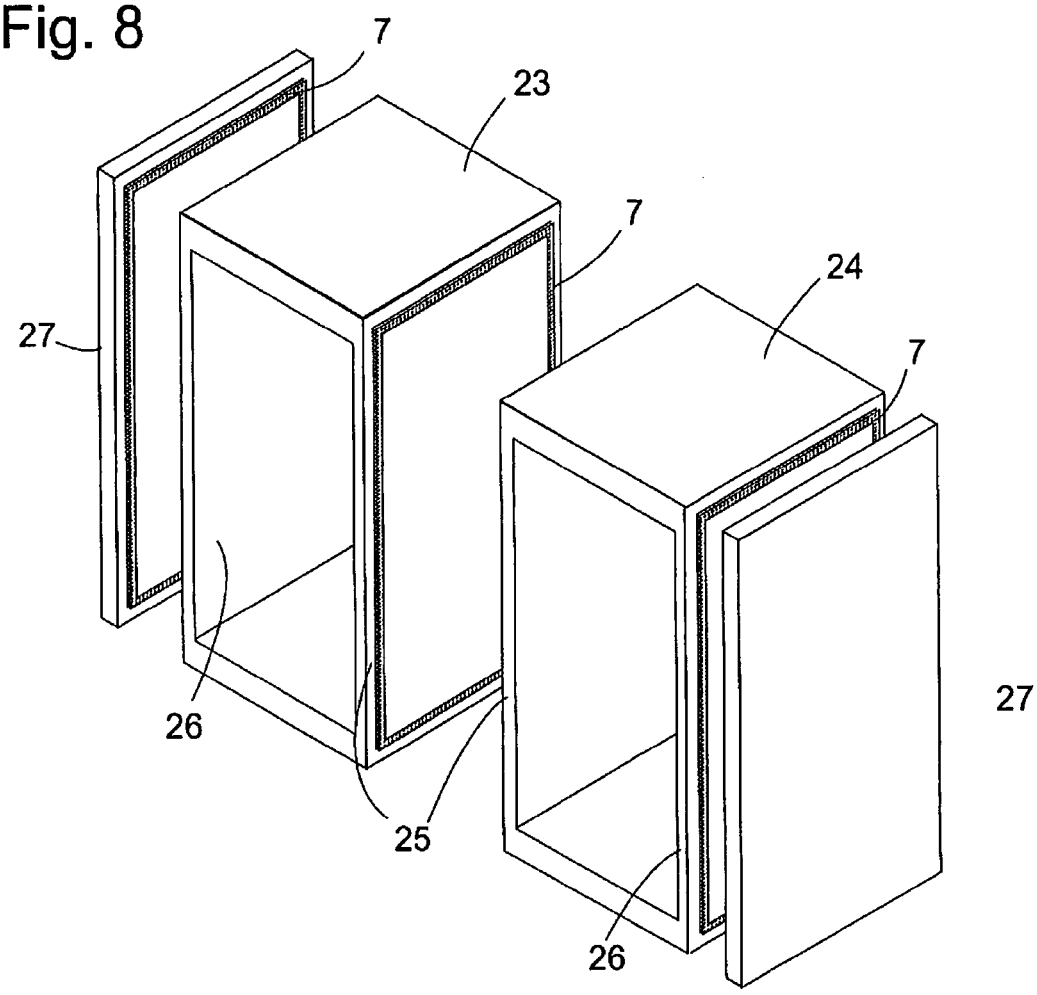
FIG. 8 shows a perspective exploded view of a refrigeration device having two housings and insulating panels that are to be mounted on the side walls of the housing.

FIG. 8 shows in an exploded perspective view a second embodiment of a refrigeration device to which the present invention can be applied. As in the case of FIG. 1, the refrigeration device has two housings 23, 24, each of which encloses an interior, although each of the housings 23, 24 has two equally strong side walls 25, 26. Of the facing side walls 25 of the housings 23, 24, one is provided with a sealing profile 7 according to one of the above-described embodiments.

The strength of the side walls 25, 26 is dimensioned on the basis of the insulation effect required between the interiors of the housings 23, 24. Consequently it does not guarantee adequate insulation against room temperature at the side walls 26 of the housings 23, 24 facing away from each other. As a supplementary measure, therefore, additional insulating panels 27 are provided in each case for mounting on an exposed outside surface of the side walls 26 facing away from each other.

Between each insulating panel 27 and a side wall 26 facing it of one of the housings 23, 24 there is likewise mounted a frame-shaped sealing profile 7 according to one of the above-described embodiments.

The right-left symmetry of the housings 23, 24 gives the manufacturer and the user alike a great degree of freedom for assembling different device types from a small number of modular components. It is thus possible, for example, to fit the housing 23 with insulating panels 27 on both sides in order thereby to obtain a single refrigeration device with an all-round wall strength adapted for operation as a refrigeration device, to fit the housing 24 with insulating panels 27 on both sides in order to obtain a wall strength adapted for operation as a freezer device, or in a combination device like that shown in FIG. 7 to swap over the positions of the housings 23, 24 as well as the position of the door hinge on the housing 23 or 24.

The invention claimed is:

1. A refrigeration device comprising:

a.) a housing having an interior;

b.) at least one housing part, the housing and the at least one housing part being interlinked to form a single unit and the housing having a surface that faces a respective surface on the at least one housing part; and c.) a sealing profile formed of a compressible foamed plastic strand and a diffusion-inhibiting membrane extending between the facing surfaces of the housing and the housing part, the membrane being made of a different material compared to the plastic strand.

2. The refrigeration device as claimed in claim 1, wherein the diffusion-inhibiting membrane fits against surfaces of the housing and the housing part.

3. The refrigeration device as claimed in claim 1, wherein the diffusion-inhibiting membrane is applied to the surface of the foamed plastic strand.

4. The refrigeration device as claimed in claim 1, wherein the sealing profile is configured by a lengthwise fold of a foamed plastic strip coated with an adhesive on one side and carrying the membrane on the other side.

5. The refrigeration device as claimed in claim 1, wherein the membrane forms a tube surrounding the foamed plastic strand.

6. The refrigeration device as claimed in claim 5, wherein the tube is formed by the joined together longitudinal edges of at least one membrane strip.

7. The refrigeration device as claimed in claim 6, wherein the longitudinal edges are joined in a manner that results in the inclusion of the foamed plastic strand.

8. The refrigeration device as claimed in claim 1, wherein the membrane is a film containing a metal.

9. The refrigeration device as claimed in claim 8, wherein the film is a plastic-metal laminated film.

10. The refrigeration device as claimed in claim 8, wherein the metal comprises aluminum.

11. The refrigeration device as claimed in claim 1, wherein the membrane includes a layer made of polychlorotrifluoroethylene (PCTFE).

12. The refrigeration device as claimed in claim 1, wherein the sealing profile is adhesively secured to at least one of the surfaces of at least one of the housing and the housing part.

13. The refrigeration device as claimed in claim 12, wherein the sealing profile is adhesively secured to surfaces of both of the housing and of the housing part.

14. The refrigeration device as claimed in claim 1, wherein the housing part is a second housing having an interior.

15. The refrigeration device as claimed in claim 1, wherein the housing part is an insulating panel.

16. The refrigeration device as claimed in claim 1, wherein the plastic strand has a width that is variable in dependence of a variable gap between the facing surfaces.

17. The refrigeration device as claimed in claim 16, wherein the plastic strand has a relaxed thickness that is compressible to a thickness that is a fraction of the relaxed thickness.

18. The refrigeration device as claimed in claim 17, wherein the membrane comprises a film.

19. The refrigeration device as claimed in claim 18, wherein the film is a plastic-metal laminated film.

20. The refrigeration device as claimed in claim 16, wherein the gap between the facing surfaces is wider by a multiple at its widest point than at its narrowest.

21. The refrigeration device as claimed in claim 1, wherein the housing includes first and second vertical side walls that together with top and bottom walls of the housing define the interior; the first and second walls having thicknesses that are different from one another.

22. The refrigeration device as claimed in claim 21, wherein the second wall is positioned adjacent the housing part and has the smaller thickness.

23. The refrigeration device as claimed in claim 1, wherein the membrane is wider than the plastic strand.

24. A refrigerator device comprising a housing having an interior;

at least one housing part being interlocked with and permanently fixed to the housing to form a single unit, the housing having a surface that faces a respective surface of the housing part, with a gap therebetween the surfaces that may be variable; and a sealing profile permanently provided between the opposed surfaces, the sealing profile including a foamed plastic strand that is compressible to accommodate for variability in the gap between the surfaces, and a diffusion-inhibiting membrane to permanently protect against moisture penetrating into the gap, whereby the membrane maintains contact with the facing surfaces of the housing and the housing part face due to compressibility of the plastic strand, regardless of variations in the width of the gap.

25. The refrigeration device as claimed in claim 24, wherein the housing has upstanding side walls having different thicknesses, such that the thinner wall is adjacent to the housing part.

26. The refrigeration device as claimed in claim 25, wherein the housing part has an interior defined at least in part by upstanding side walls having different thicknesses, the thinner of which is adjacent the thinner wall of the housing.

27. The refrigeration device as claimed in claim 24, wherein the membrane is a film containing a metal.

28. The refrigeration device as claimed in claim 27, wherein the metal comprises aluminum.

29. The refrigeration device as claimed in claim 24, wherein the membrane includes a layer made of polychlorotrifluoroethylene (PCTFE).

30. The refrigeration device as claimed in claim 24, wherein the housing part is an insulating panel.

31. The refrigerator device as claimed in claim 24, wherein the housing includes an opening surrounded by a perimeter surface oriented towards a first side of the housing, the perimeter surface being adapted to engage a sealing element of a door attachable to said housing and wherein the sealing profile is provided on an outer side wall of the housing juxtaposed approximately at a right angle relative to the front side of the housing.

* * * * *

UNITED STATES PATENT AND TRADEMARK OFFICE

CERTIFICATE OF CORRECTION

PATENT NO. : 8,511,766 B2
APPLICATION NO. : 11/918500
DATED : August 20, 2013
INVENTOR(S) : Sonnenfroh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1401 days.

Signed and Sealed this
Fifteenth Day of September, 2015

Michelle K. Lee

Michelle K. Lee
*Director of the United States Patent and Trademark Office*